United States Patent [19]

Snyder

[11] 4,117,914

[45] Oct. 3, 1978

[54] SLIDABLE SUITCASE HANDLE

[75] Inventor: John M. Snyder, 186 Riverside Dr., New York, N.Y. 10024

[73] Assignees: John M. Snyder; Bernard J. Steinberg, both of New York, N.Y.; Edward Halle, Fort Lauderdale, Fla.

[21] Appl. No.: 809,060

[22] Filed: Jun. 22, 1977

[51] Int. Cl.[2] ..... A45C 13/26

[52] U.S. Cl. ..... 190/58 R; 16/110.5

[58] Field of Search ..... 190/58 B, 58 R, 56, 190/57, 39, 60; 16/110.5, 112, 124, 125, 126

[56] References Cited

U.S. PATENT DOCUMENTS

| | | | |
|---|---|---|---|
| 3,513,952 | 5/1970 | Warner | 190/58 B |
| 3,793,674 | 2/1974 | Kneir | 16/126 |

FOREIGN PATENT DOCUMENTS

| | | | |
|---|---|---|---|
| 2,253,358 | 5/1974 | Fed. Rep. of Germany | 190/58 B |
| 320,419 | 10/1929 | United Kingdom | 190/58 R |
| 678,514 | 9/1952 | United Kingdom | 190/56 |
| 303,594 | 1/1929 | United Kingdom | 190/58 R |

*Primary Examiner*—Herbert F. Ross
*Attorney, Agent, or Firm*—Edward Halle

[57] ABSTRACT

An item with a carrying handle, such as a suitcase, luggage or similar item is provided with a slidable handle to permit the handle to be moved from a central portion of the top of the suitcase to a side edge of the top of the suitcase so that two suitcases similarly made may be carried with one hand when the handle is moved to the edge of each suitcase and placed side by side, or a single suitcase may be carried with ease when the handle is moved to the central portion of the suitcase.

9 Claims, 4 Drawing Figures

SLIDABLE SUITCASE HANDLE

BACKGROUND OF THE INVENTION

The invention relates to hand carrying of articles or items such as luggage, suitcases, packages or similar items which are provided with some kind of handle for gripping the item. In the case of suitcases particularly, when a person attempts to grip or grasp the handles of two suitcases with one hand, they are usually too far apart due to the width of the suitcases for the attempt to be practical or even possible. This may be true whether the suitcases are of the same size or different sizes. In this invention the problem is solved by providing slidable handles which can be moved to positions adjacent to each other when two suitcases are placed side by side and the handles may be gripped in such position by one hand of the user. A person by the use of the invention may be able to carry four suitcases, two in each hand, with the same facility as such person would carry two suitcases, one in each hand.

SUMMARY OF THE INVENTION

The invention relates to a suitcase construction in which the handle is fitted to the suitcase by means of at least one, preferably more, slide and slide holder arrangements. The slide holders are placed on the top portion of the suitcases in a manner which will permit the slides on the handles to move from a central top portion to an edge top portion. This permits two suitcases of such construction, especially when of equivalent size or height, to be placed side by side with the handles in adjacent positions for the grasp of such handles by a single hand.

It is an object of the present invention to provide a gripping apparatus, such as handles, for items to enable the carrying of a plurality of items with such handles, especially luggage, in one hand. Further objects and advantages of the present invention will be apparent from the accompanying figures in detailed description.

BRIEF DESCRIPTION OF THE DRAWINGS

Similar numerals refer to similar parts throughout the several views.

DESCRIPTION OF THE PREFERRED EMBODIMENT

Figure 1:
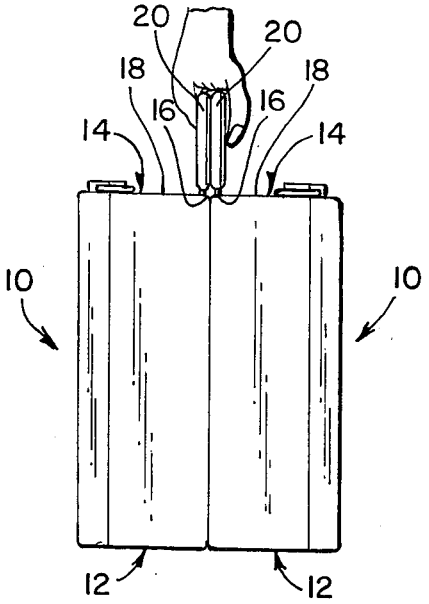
FIG. 1 is an end elevation.
Figure 2:
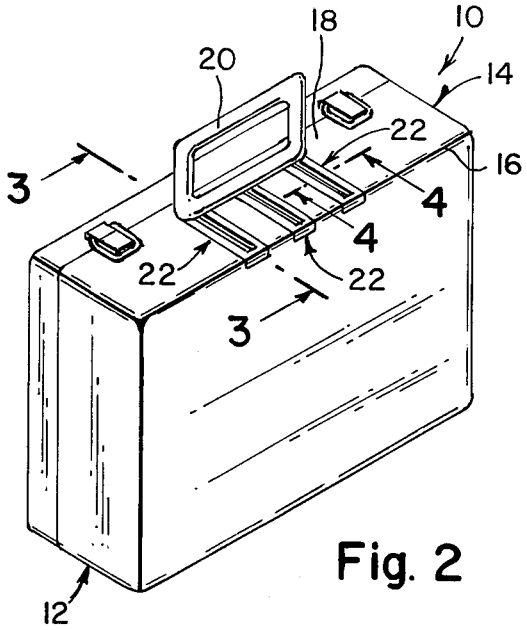
FIG. 2 is a perspective view.
Figure 3:
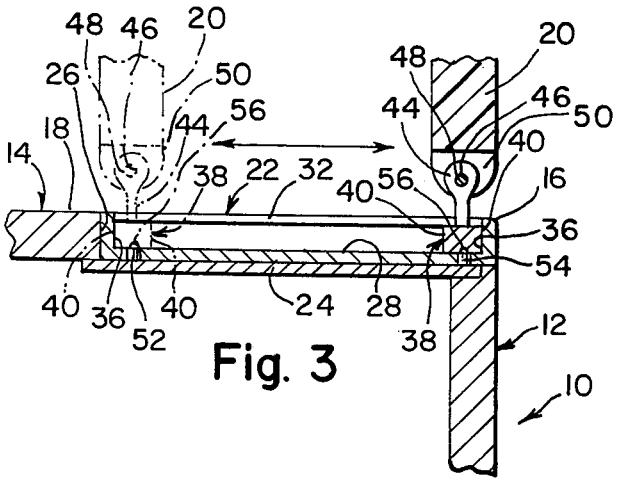
FIG. 3 is a sectional view along the lines 3—3 in FIG. 2 with parts in phantom.
Figure 4:
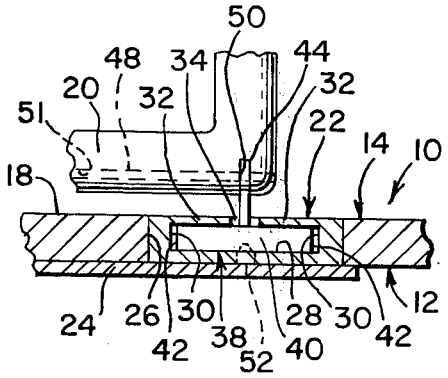
FIG. 4 is a sectional view along the lines 4—4 in FIG. 2 with parts cut away.

Reference to FIG. 1 of the drawings will show a pair of items, such as suitcases, made in accordance with the invention. Both suitcases are of identical construction as further illustrated in FIGS. 2, 3 and 4 of the drawings. The suitcase item 10 has a main body portion 12, which has a top portion 14 and a top edge 16, as well as a central top portion 18. In FIG. 2 of the drawings the handle 20 provided for the suitcase is located at the central top portion 18. In FIG. 1 of the drawings the handles 20 of each of the suitcases 10 are located at the top edge 16 of each suitcase 10, respectively. The two suitcases 10 are positioned against each other so that the top edges 16 are adjacent, thereby placing the handles 20 adjacent to each other for gripping by a single hand.

When the handle 20 is in position at the central top portion, as shown in FIG. 2, the suitcase 10 may be carried as a single suitcase in the usual manner with a centrally located handle. When the handle 20 is at the top edge 16, as shown in FIG. 1, a pair of suitcases 10 may be carried in accordance with the usage of the invention by gripping both handles similtaneously with one hand. The movable connection between the handle 20 and the suitcase 10 is made possible by the particular construction of the invention which includes at least one slide holder 22 connected to the suitcase 10 by means of plate means 24. If the suitcase 10 construction is strong, having a wooden, steel, or other type of frame suitable to bear the weight of the slide holder 22 connection, then the plate means 24 may be eliminated.

The slide holder 22 may be placed in an opening 26 in the top portion 14 of the body portion 12 and connected to the plate 24 by any means, such as welding or by any other fastening means, either mechanical or adhesive. The plate 24 extends beyond the opening 26 underneath the top portion 14 and may be secured to the top portion 14 by any mechanical or adhesive means. The slide holder 22 comprises a bottom 28, sides 30 and a channel top comprising a pair of strips 32 with a channel 34 between them.

The slide holder also comprises channel ends 36. The handle 20 is provided with at least one slide 38 having ends 40 and sides 42 and a handle connector 44 comprising an opening 46 to accommodate a pin 48. The handle 20 is provided with recess means 50 so that the handle connector 44 opening 46 may be placed within such recess for connection by means of the pin means 48 which can be placed through pin receiver opening 51 in the handle 20. The channel ends 36 are provided with stop means 52 and 54 to position the slides 38 either at the central position 18 or the edge position 16. In order to maintain the handle 20 and its slides 38 in central or edge positions, a central stop 52 is provided at the central position and an edge stop 54 is provided at the stop position. In the preferred form of the invention, the stops 52 and 54 are the usual types of bullet stops which comprise a ball bearing and a spring arrangement and the slides 38 are provided with openings 56 to serve as stop receivers. The slides can be manually pushed to expel the ball portion of the stops 52 and 54 from the stop receiver openings 56 in the slide, so that the handle 20 and its slide or slides 38 can be moved by manual pressure from a central position to an edge position and vice versa. The operation of the bullet stop is sufficiently well known to need no further explanation in this respect. Any other type of stop and holding means for the slides may be employed.

It is to be understood that the invention comprises a single suitcase or item made in the manner described hereinabove which may be used as a single unit with the handle in central position or which may be paired with another suitcase made in accordance with the invention with handles in edge position, as shown in FIG. 1, so that more than one suitcase can be carried by one hand simultaneously.

While I have defined or described my invention in its preferred form, there are other forms which it may take without departing from the spirit and scope of the invention and it is desired to be protected for all forms coming within the claims hereinbelow.

Wherefore I claim:

1. An item for carrying material comprising a main body portion, comprising a top portion, comprising at least one top edge and at least one central portion and a carrying handle characterized in that the carrying handle is slidably connected to the top portion of the item by means which selectively permit sliding movement of the carrying handle from the central top portion to the edge top portion of said item; in which the means to selectively permit sliding movement of the carrying handle comprises at least one slide holder secured on said edge portion and said central portion of said top portion to slidably recieve said handle.

2. The item as claimed in claim 1 comprising at least one slide on said carrying handle in combination with said slide holder.

3. The item as claimed in claim 2 comprising at least one pair of slide and slide holder combinations.

4. The item as claimed in claim 3 comprising a plurality of slide and slide holder combinations.

5. The item as claimed in claim 2, in which the slide holder comprises a channel-like shape with a top portion having a channel opening and the slide comprises at least one handle connector adapted to travel along said opening.

6. The item as claimed in claim 5, in which there is at least one slide stop to position the slide at a selected portion of the slide holder.

7. The item as claimed in claim 6 which comprises slide stop means at the central portion and edge portion of the slide.

8. The item as claimed in claim 7, in which the slide stop means comprise bullet type fasteners and the slide comprises a bullet receiving means.

9. The item as claimed in claim 8, in which there are a plurality of slide constructions and slides and in which the slides are connected to the carrying handle by means of the handle connectors.

* * * * *